US007717534B2

(12) United States Patent
Inaba et al.

(10) Patent No.: US 7,717,534 B2
(45) Date of Patent: May 18, 2010

(54) PRINTING APPARATUS AND IMAGE PROCESSING APPARATUS

(75) Inventors: Moriyoshi Inaba, Kodaira (JP); Shinichi Saijo, Fuchu (JP); Naohisa Obata, Iwaki (JP); Jouji Odaka, Niiza (JP)

(73) Assignee: Canon Finetech Inc., Joso-shi (JP)

( * ) Notice: Subject to any disclaimer, the term of this patent is extended or adjusted under 35 U.S.C. 154(b) by 0 days.

(21) Appl. No.: 11/384,302

(22) Filed: Mar. 21, 2006

(65) Prior Publication Data

US 2006/0214969 A1 Sep. 28, 2006

(30) Foreign Application Priority Data

Mar. 23, 2005 (JP) ..... 2005-084906

(51) Int. Cl.
*B41J 29/393* (2006.01)

(52) U.S. Cl. ..... 347/19

(58) Field of Classification Search ..... 347/15, 347/19, 41

See application file for complete search history.

(56) References Cited

U.S. PATENT DOCUMENTS

| | | | | |
|---|---|---|---|---|
| 6,106,088 | A * | 8/2000 | Wafler | 347/7 |
| 6,827,415 | B2 * | 12/2004 | Otokita et al. | 347/14 |
| 7,059,700 | B2 * | 6/2006 | Aihara | 347/14 |
| 7,175,252 | B2 * | 2/2007 | Sonobe | 347/23 |
| 7,207,644 | B2 * | 4/2007 | Kaburagi | 347/19 |
| 2005/0024418 | A1 * | 2/2005 | Yoshiyama | 347/19 |

* cited by examiner

*Primary Examiner*—Matthew Luu
*Assistant Examiner*—Justin Seo
(74) *Attorney, Agent, or Firm*—Fitzpatrick, Cella, Harper & Scinto

(57) ABSTRACT

This invention provides a printing apparatus and an information processing apparatus which can process precise information on the number of pixels printed by nozzles of the print head without degrading throughput and properly manage the service life of the print head. To this end, a plurality of nozzles of the print head are divided into a plurality of blocks and a nozzle in each of the blocks which prints a maximum number of pixels in a predetermined unit print volume is taken to be a representative nozzle. In each of the blocks, the numbers of pixels printed by the representative nozzle for every unit print volume are accumulated and managed.

11 Claims, 11 Drawing Sheets

| NOZZLE | DOT COUNT | |
|---|---|---|
| 602-1 | 0 | |
| 602-2 | 0 | |
| 602-3 | 0 | |
| 602-4 | 0 | |
| 602-5 | 0 | |
| 602-6 | 0 | |
| 602-7 | 26 | MAXIMUM PRINT NOZZLE |
| 602-8 | 1 | |
| 602-9 | 1 | |
| 602-10 | 1 | |
| 602-11 | 1 | |
| 602-12 | 7 | |
| 602-13 | 9 | |

601A

| NOZZLE | DOT COUNT | |
|---|---|---|
| 602-14 | 7 | |
| 602-15 | 7 | |
| 602-16 | 6 | |
| 602-17 | 6 | |
| 602-18 | 7 | |
| 602-19 | 7 | |
| 602-20 | 9 | MAXIMUM PRINT NOZZLE |
| 602-21 | 7 | |
| 602-22 | 1 | |
| 602-23 | 1 | |
| 602-24 | 1 | |
| 602-25 | 1 | |
| 602-26 | 1 | |

601B

PRINTING APPARATUS AND IMAGE PROCESSING APPARATUS

This application claims priority from Japanese Patent Application No. 2005-084906 filed Mar. 23, 2005 which are hereby incorporated by reference herein.

BACKGROUND OF THE INVENTION

1. Field of the Invention

The present invention relates to a printing apparatus that prints an image on a print medium by using a print head capable of ejecting ink from a plurality of nozzles and also to an image processing apparatus that sends print data to the printing apparatus.

2. Description of the Related Art

Generally, a printing apparatus using an ink ejecting print head may not be able to perform the normal printing operation when the number of ink ejections from the nozzles of the print head exceeds a predetermined value.

Among the ink jet print heads there is a thermal ink jet print head which has electrothermal transducers (heaters) as a means to generate ink ejection energy. This type of print head quickly heats ink by the electrothermal transducer to create a bubble in the ink and expels an ink droplet from the nozzle by a pressure of the expanding bubble. Such a thermal ink jet print head is subjected to stresses, such as heat, pressure and chemical reactions with ink, over a long period of use in the ink jet printing apparatus. These stresses increase the resistance of the heater, causing an excess heating of the heater and therefore a burning of the ink. This in turn will lead to a reduced volume of ink ejected, resulting in the print head failing to eject ink properly, degrading a quality of printed image.

A conventional practice to prevent this from happening, for example, involves counting the number of ink ejections from the print head and, when the count value reaches a predetermined value, notifying the user that the print head has reached the end of its life. More specifically, a plurality of nozzles of the print head is divided into nozzle blocks and, each time one page is printed, the total number of ink ejections in every block is monitored. The total number of ejections in each block is the total number of ink droplets ejected from the nozzles in that block and equals the total number of dots (printed dots) formed by the ejected ink droplets. The total number of dots in each block is counted by a host computer (or host device) and the count value is sent to the printing apparatus as dot count data. The printing apparatus totals the dot count data for each nozzle block of the print head as the number of printed pages increases. In this manner, the total ink droplets ejected from each nozzle block of the print head is managed and, when the total count value reaches a specified value, it is decided that the print head has reached the end of its longevity.

The above conventional method, however, has the following problems.

(1) The dot count data needs to be processed for each printed page. Thus, the host computer has a heavy burden of counting the dots to make the dot count data and the printing apparatus is burdened heavily by the processing of adding up the dot count data. As a result, throughput inevitably degrades.

(2) In addition to the print data the host computer must send the dot count data for each print page to the printing apparatus. This lowers the print data transfer rate.

(3) The dot count data is preferably managed for each nozzle. But in reality the dot count data is managed for each group of multiple nozzles (for each nozzle block) as described in (1) and (2), so the accuracy of the dot count data as management data on the print head serviceable life degrades. For example, when the dot count data is managed for each 10 nozzles, a distinction cannot be made between a case where ink is ejected uniformly from all 10 nozzles and a case where a frequency of ink ejection from a particular nozzle is extremely high. In this situation, an error of up to 10 times can occur. Particularly, in a printing apparatus using an elongate print head extending over the entire printing width of a print medium (line head), if a line which is one dot thick is to be printed, the number of ink ejections from a particular nozzle becomes extremely large, making the above problem conspicuous.

SUMMARY OF THE INVENTION

An object of this invention is to provide a printing apparatus and an information processing apparatus which can process accurate information on the number of pixels printed by the nozzles of the print head, without causing a degradation of throughput, to properly manage a service life of the print head.

In a first aspect of the present invention, there is provided a printing apparatus for printing an image on a print medium by using a print head capable of ejecting ink from a plurality of nozzles, the plurality of nozzles being divided into a plurality of blocks, and an accumulated number of pixels printed by the nozzles being managed for each of the blocks; the printing apparatus comprising:

management means for picking up from among the nozzles in each of the blocks a representative nozzle which prints a maximum number of pixels in a predetermined unit print volume, accumulating the number of pixels printed by the representative nozzle in each of the predetermined unit print volumes, and managing the accumulated result.

In a second aspect of the present invention, there is provided a printing apparatus for printing an image on a print medium by using a print head capable of ejecting ink from a plurality of nozzles, the plurality of nozzles being divided into a plurality of blocks, and an accumulated number of pixels printed by the nozzles being managed for each of the blocks; the printing apparatus comprising:

management means for multiplying the number of standard image pixels printed by a representative nozzle in each of the blocks in a predetermined unit print volume by a print volume on the print medium, and managing the multiplied result.

In a third aspect of the present invention, there is provided an image processing apparatus for sending print data to a printing apparatus, the printing apparatus printing an image on a print medium by using a print head capable of ejecting ink from a plurality of nozzles, the plurality of nozzles being divided into a plurality of blocks, and an accumulated number of pixels printed by the nozzles being managed for each of the blocks; wherein the printing apparatus comprises management means for multiplying the number of standard image pixels printed by a representative nozzle in each of the blocks in a predetermined unit print volume by a print volume on the print medium, and managing the multiplied result;

the image processing apparatus comprises transmission means for sending information on the number of standard image pixels to the printing apparatus.

With this invention, a plurality of nozzles of the print head are divided into two or more blocks and, in each of the blocks, a representative nozzle, which has printed a maximum number of pixels in each predetermined unit print volume, is considered and the numbers of pixels printed by the representative nozzle are totaled for management. Alternatively, in each of the blocks into which the nozzles of the print head are divided, the number of printed pixels per unit print volume is multiplied by a print volume on the print medium and the multiplied results are totaled for management. This allows an efficient management of information on the number of pixels printed by the nozzles. As a result, information can be processed without causing throughput degradation, making it possible to manage the service life of the print head precisely.

For example, if lines are printed, a precise number of printed pixels (dots) can be counted, improving the management accuracy of the print head longevity.

Further, prior to the printing operation, the image processing apparatus (host device) may notify information on the number of printed pixels (dots) of a standard print image to the printing apparatus. For example, the number of printed pixels (dots) on pages of the printed medium can be measured by using the number of dots of the standard print image as a standard dot count, and the life of the print head can be managed based on the measured number of printed pixels (dots) on pages of the printed medium. In this case, there is no need to execute the dot count measuring processing for every printed page, reliably preventing degradation in throughput. Further, since the information on the number of printed pixels of the standard print image is sent out only once for each multiple pages, the transfer of this information does not interfere with the transfer of print data from the image processing apparatus (host device) to the printing apparatus.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Now, example embodiments of this invention will be described in detail by referring to the accompanying drawings.

First Embodiment

Figure 1:
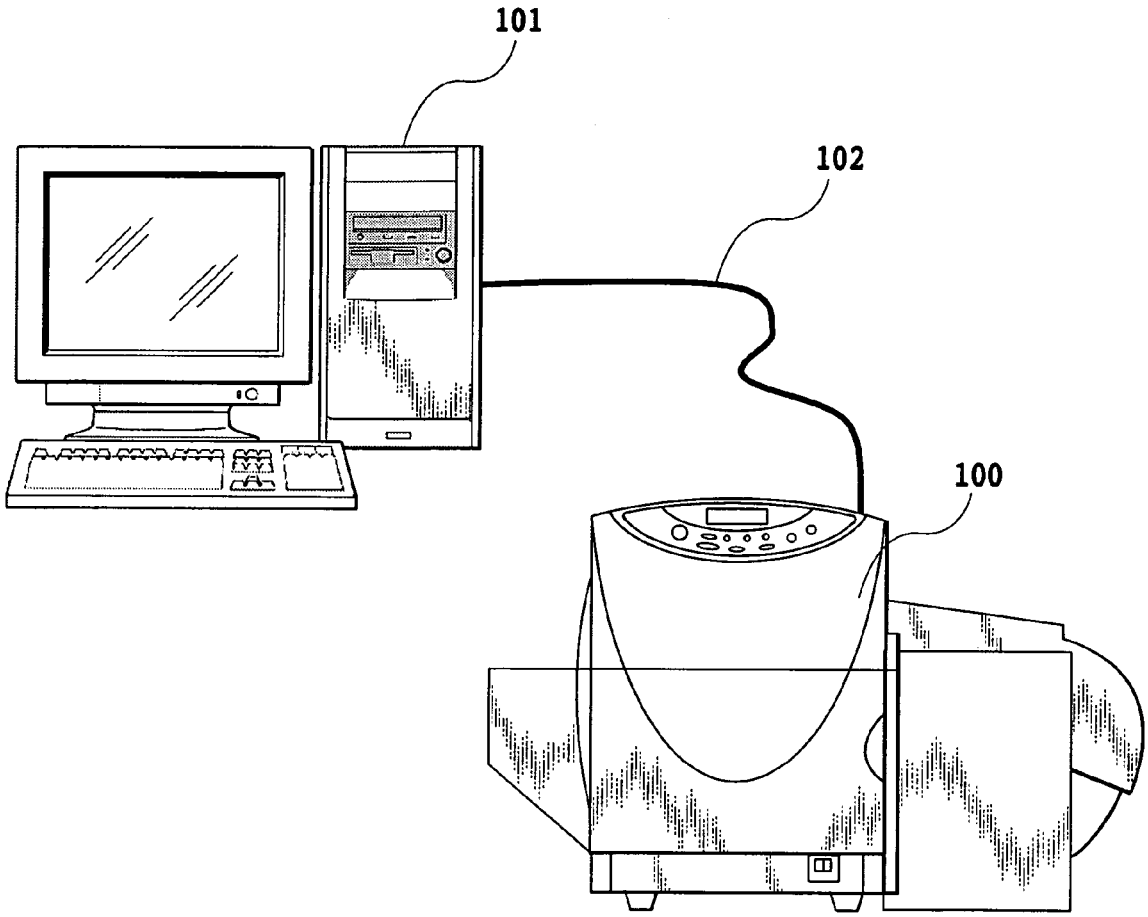
FIG. 1 shows an outline configuration of a printing system having a printing apparatus of a first embodiment of this invention and a host computer connected with the printing apparatus.

FIG. 1 shows a system configuration in which a printing apparatus of this embodiment is connected to a host computer.

The printing apparatus 100 is connected to a host computer (host device) 101 as an information processing apparatus through a cable 102. The host computer 101 outputs print data and dot count information on each block of a standard print image as a control command to the printing apparatus 100 through the cable 102. The host computer 101 receives status information (e.g., error information) as a control command and notifies the status of the printing apparatus 100 to the user.

Figure 2:
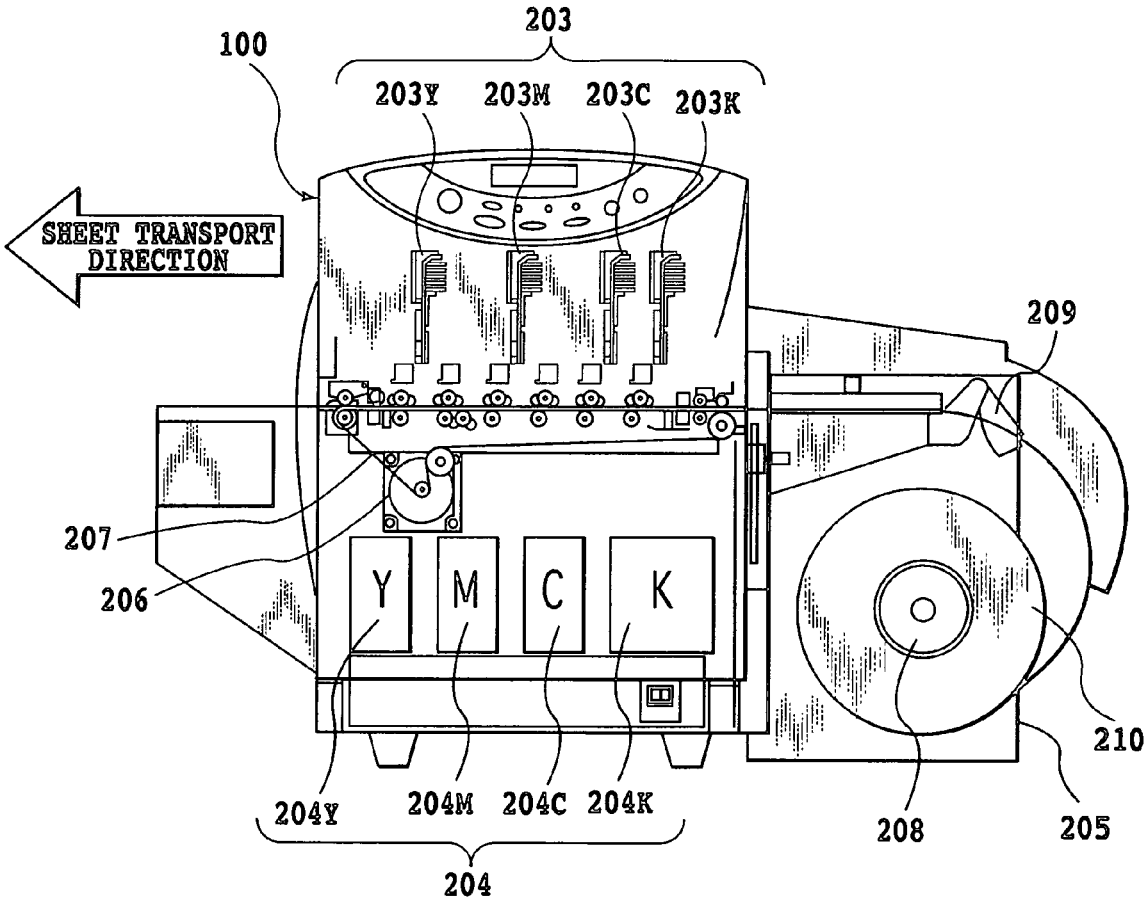
FIG. 2 shows an outline configuration of the printing apparatus of FIG. 1.

FIG. 2 shows an outline configuration of the printing apparatus 100 of this embodiment.

The printing apparatus 100 in this example can print an image on a continuous label sheet (print medium) 210. Denoted 205 is a roll unit in which is installed a continuous label sheet 210 which has labels lightly stuck to a base sheet thereof. The roll unit 205 supplies the continuous label sheet 210 to a transport unit. The transport unit has a transport motor 206 and a transport belt 207 and feeds the continuous label sheet 210 in a direction of arrow in the figure during the printing operation. In this example, a transport path of the continuous label sheet 210 is provided with a transport inlet on the roll unit 205 side (at right in FIG. 2) and a transport outlet on the opposite side (at left in FIG. 2).

Print heads (printing means) 203 mounted in the printing apparatus 100 are a black ink (K) print head 203K, a cyan (C) ink print head 203C, a magenta (M) ink print head 203M and a yellow (Y) ink print head 203Y. These print heads 203 are of a full line type and have a column of nozzles extending over a width of the label piece lightly stuck to the continuous label sheet 210. The four print heads 203 eject K, C, M and Y inks to form a full color image. The inks to be ejected from the associated print heads 203 are supplied by a pump not shown from corresponding ink cartridges 204. Denoted 204K is an ink cartridge containing a black (K) ink, 204C an ink cartridge containing a cyan (C) ink, 204M an ink cartridge containing a magenta (M) ink, and 204Y an ink cartridge containing a yellow (Y) ink.

The roll unit 205 includes a roll drive shaft 208 on which the continuous label sheet 210 is mounted, a roll sensor lever 209 whose position changes according to a slack of the continuous label sheet 210, and a roll motor not shown that drives the roll drive shaft 208. The continuous label sheet 210 can be stably fed by controlling (driving and stopping) the roll motor according to the position of the roll sensor lever 209.

Figure 3:
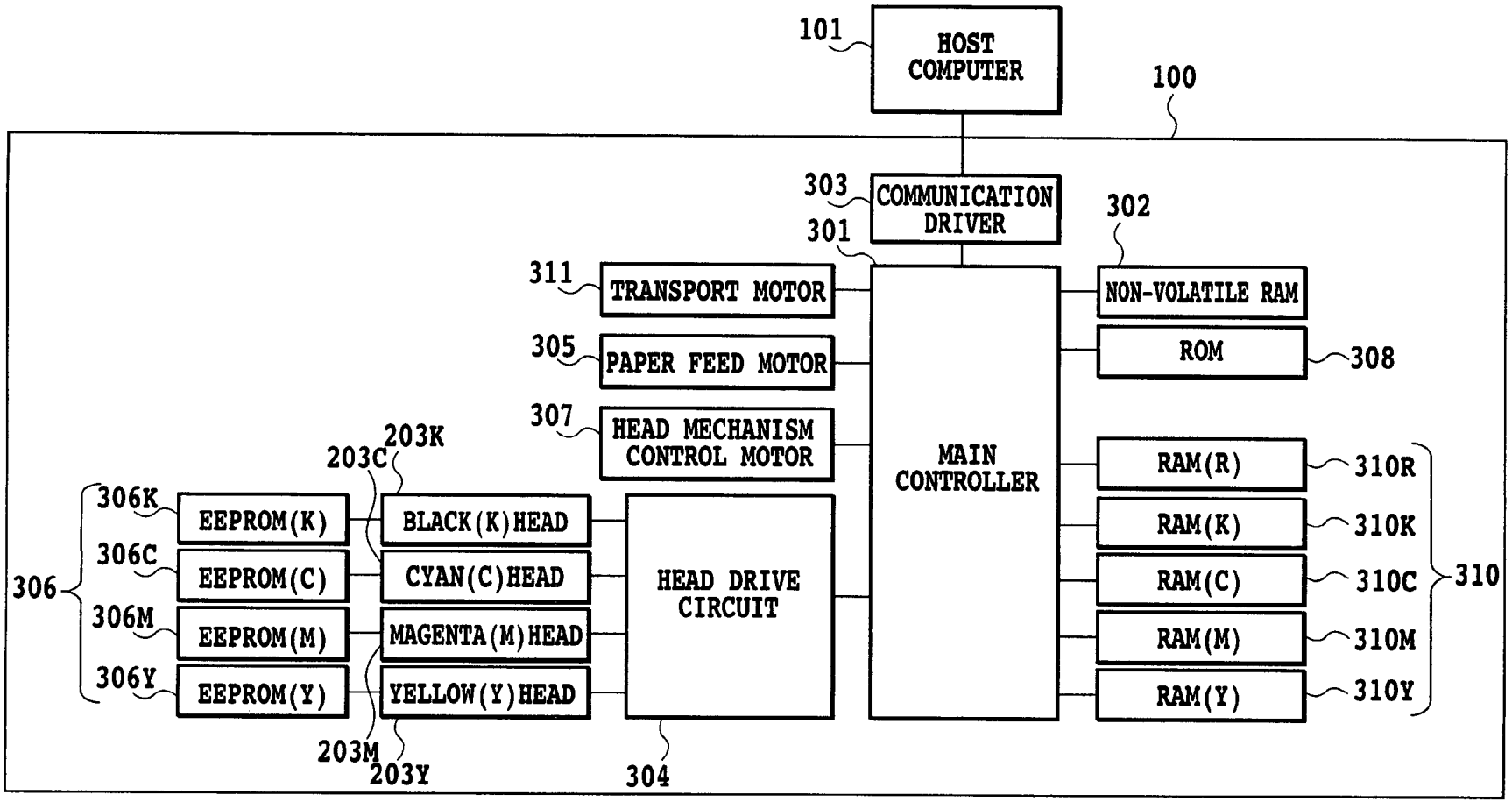
FIG. 3 is an outline block diagram showing a control system of the printing apparatus of FIG. 1.

FIG. 3 shows an outline block diagram of a control system in the printing apparatus 100 of this embodiment.

The host computer (host device) 101 instructs the printing apparatus 100 to start the printing operation by transferring print data and dot count information on the standard print image as a control command to the printing apparatus 100. The host computer 101 can also send to the printing apparatus 100 a paper setting command specifying the number of labels to be printed by the printing apparatus 100 and a type and size of the continuous label sheet 210.

The communication between the host computer 101 and the printing apparatus 100 is controlled by a communication driver 303, and the printing apparatus 100 receives a command (e.g., data command, paper setting command and dot count command) from the host computer 101. The printing apparatus 100 develops the received print data into a bitmap image data of each color component and writes them in RAM 310K, 310C, 310M and 310Y. In each of the RAM 310K, 310C, 310M, 310Y, image data of color components corresponding to black (K), cyan (C), magenta (M) and yellow (Y) ink are rasterized. The print head dot count command for each predetermined block (described later) and the paper setting command, such as the number and size of labels and the number of labels to be printed, are stored in RAM 310R. Then, the data command and the paper setting command are rasterized in the associated RAMs 310 (310Y-310R), after which the print head 203 (203K-203Y) is moved to the print position by a head drive mechanism control motor 307.

In the printing operation, the main controller 301 reads print data successively from RAM 310K-310Y in synchronism with the feeding of the continuous label sheet 210. The print data is output through a head drive circuit 304 to the associated print heads 203K-203Y that eject corresponding color inks. The print heads 203K-203Y eject their assigned color inks according to the input print data to form a multicolor image.

When the printing operation based on the print data is finished, the dot count of the standard print image multiplied by the number of printed pages (labels) is added to the value of the head service life management data stored in EEPROMs 306 (306K-306Y) and the added result is stored there. The EEPROMs 306 (306K-306Y) correspond to the print heads 203K-203Y, respectively. When the value of the head service life management data after addition exceeds a predetermined value, a command indicating that the head has reached the end of its life is sent to the host computer 101 through the communication driver 303. Such a control is performed by the main controller 301 executing a control program stored in ROM 308.

The host computer 101 as the information processing apparatus may perform a part of the functions of the printing apparatus shown in FIG. 3. For example, the head service life management data may be managed by the host computer 101.

Figure 4:
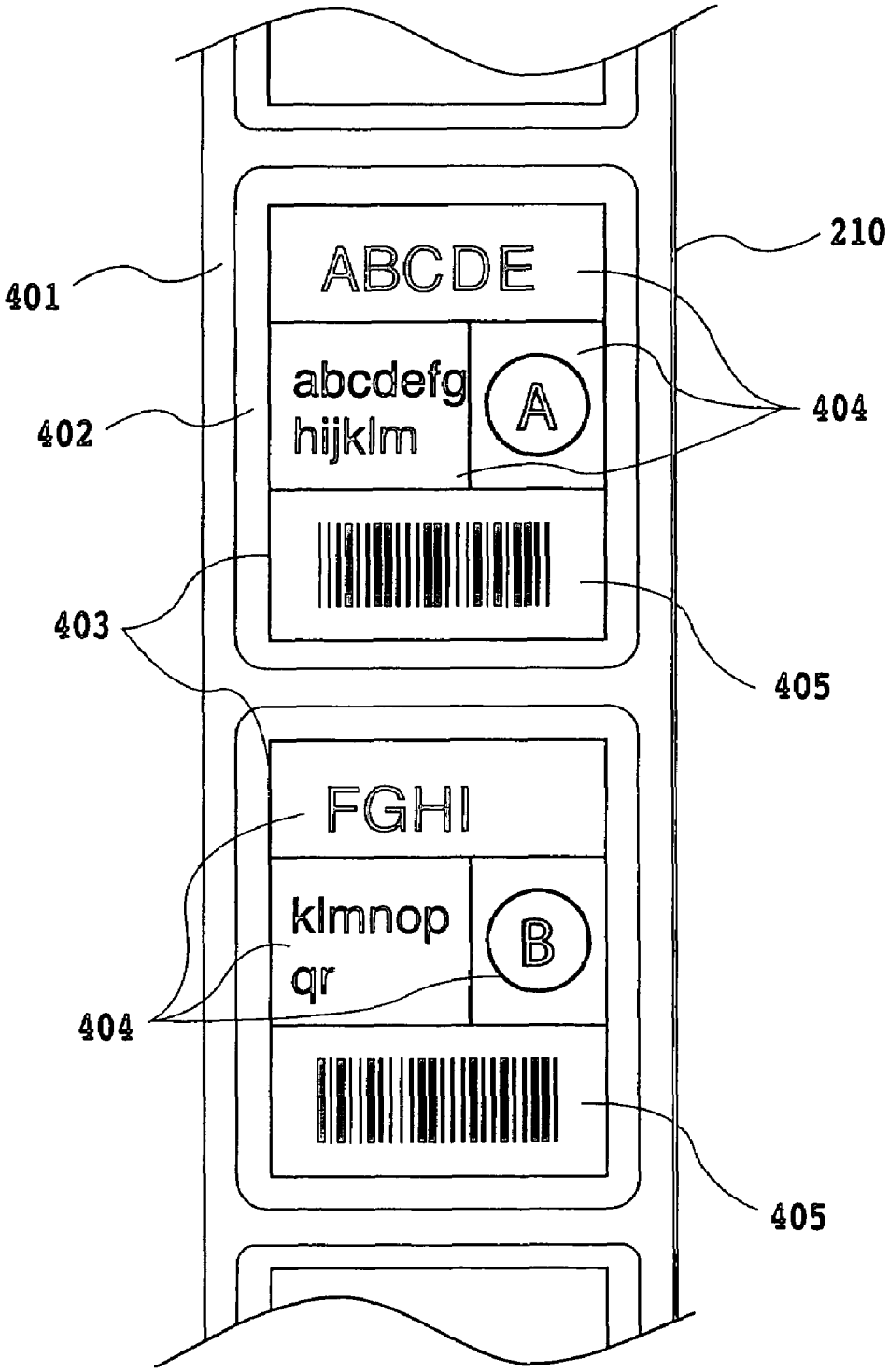
FIG. 4 shows an example image printed by the printing apparatus of FIG. 1.

FIG. 4 is an explanatory diagram showing the continuous label sheet 210 in this example.

The elongate continuous label sheet 210 is wound in a roll on a cylindrical hollow core and FIG. 4 shows a part of the continuous label sheet 210. A large number of labels 402 that can be printed on their front surface are lightly stuck at equal intervals to a base sheet 401. The printing apparatus 100 can print a different image on each of a plurality of labels 402 at high speed by overlapping field data that is variable for each label piece 402 on a form data that is common to a plurality of labels 402. In this example, the form data is a frame line 403 and the field data includes character strings 404 and a bar code 405.

FIGS. 5A-5E are explanatory diagrams showing how the printing apparatus 100 measures a dot count as the dot count information on the standard print image. In this example, of the print data for a plurality of pages corresponding to a plurality of labels 402, a print image based on the print data on the first page is taken to be a standard print image 500 (see FIG. 5A). A dot count for this standard print image 500 is measured by the host computer 101.

Figure 5A:
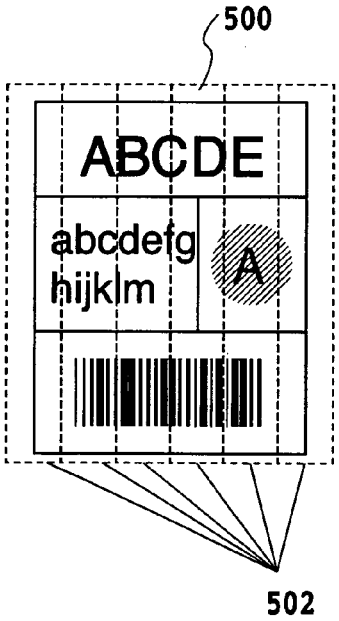
FIG. 5A is an explanatory view showing a standard image that can be printed by the printing apparatus of FIG. 1.
Figure 5B:
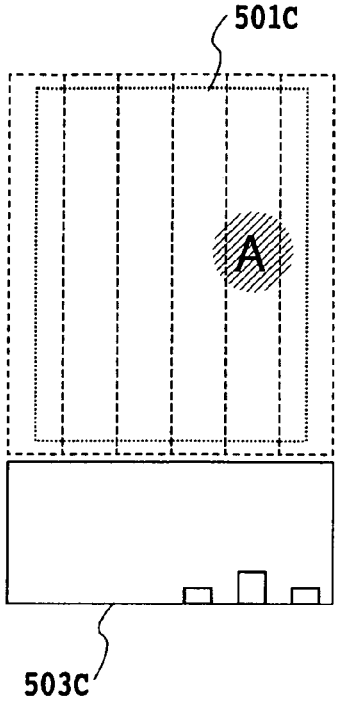
FIGS. 5B, 5C, 5D and 5E are explanatory views showing dot count information on those portions of the standard image of FIG. 5A which are printed with cyan, black, yellow and magenta ink, respectively.
Figure 5C:
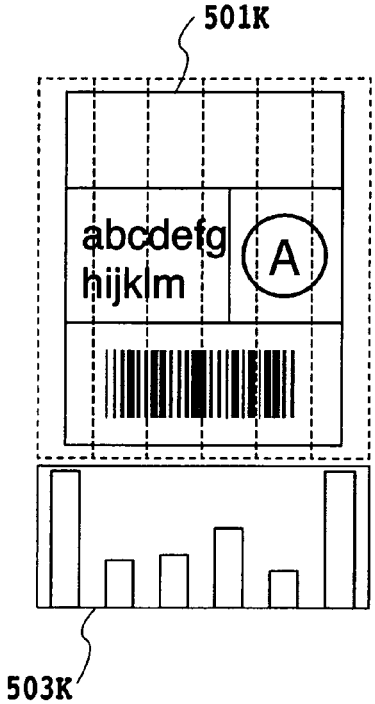
Figure 5D:
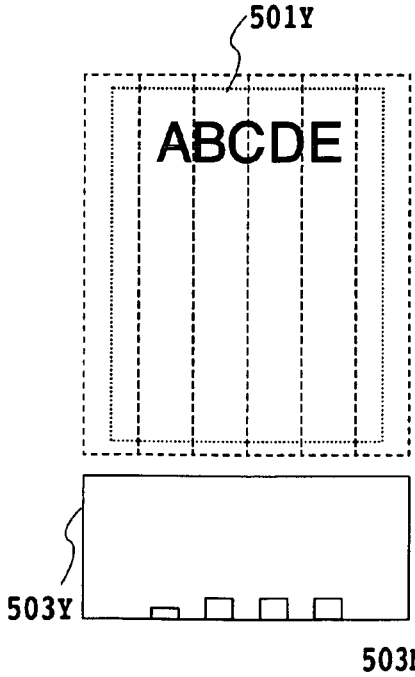
Figure 5E:
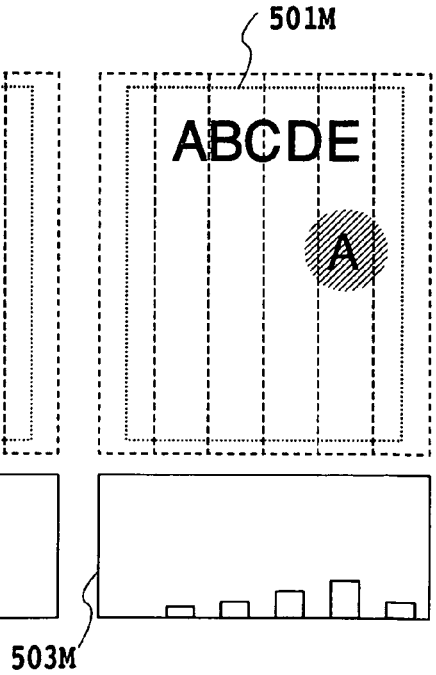

The standard print image 500 of FIG. 5A is printed using print heads of four colors. So, the standard print image 500 is separated into images 501C-501M of different ink colors. Denoted 501C is a print image formed with a cyan (C) ink, 501K a print image formed with a black (K) ink, 501Y a print image formed with a yellow (Y) ink, and 501M a print image formed with a magenta (M) ink. Further, the print images 501C-501M of different color components are each divided into predetermined blocks 502. In each block 502 of the print images 501C-501M, a nozzle which forms the largest number of dots (equivalent to the number of ejected ink droplets (dot count)) is detected (hereinafter referred to as a "maximum print nozzle"). A bar graph 503C of FIG. 5B shows the number of ink droplets ejected from the maximum print nozzle of the cyan (C) print head (dot count) in each block 502. A bar graph 503K of FIG. 5C shows the dot count of the maximum print nozzle of the black (K) print head in each block 502. Similarly, a bar graph 503Y of FIG. 5D shows the dot count of the maximum print nozzle of the yellow (Y) print head in each block 502 and a bar graph 503M of FIG. 5E shows the dot count of the maximum print nozzle of the magenta (M) print head in each block 502.

The dot count in each block as dot count information on the standard print image 500 is transferred from the host computer 101 to the printing apparatus 100.

Figures 6A, 6B, 6C:
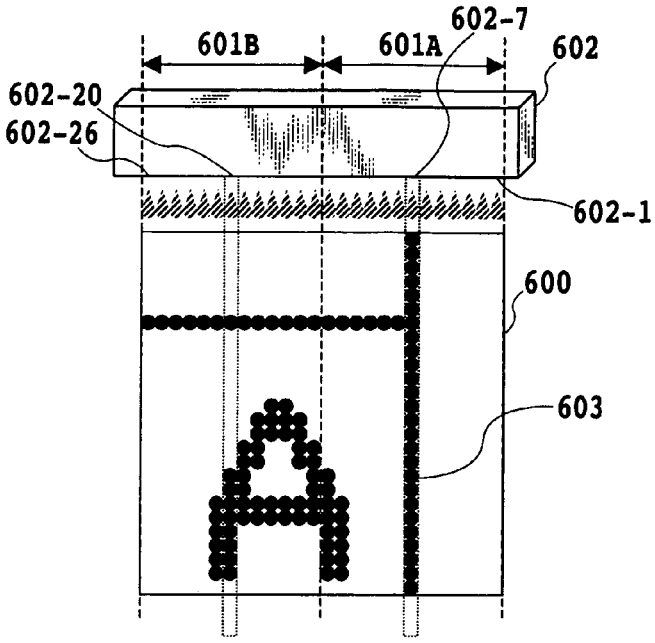
FIG. 6A is an explanatory view showing a relation between the print head and a printed image.
FIG. 6B is a table showing dot count information for a first block in the print head of FIG. 6A.
FIG. 6C is a table showing dot count information for a second block in the print head of FIG. 6A.

FIGS. 6A to 6C show in more detail how the dot count is measured.

In this example, the total number of nozzles in the print head 602 is 26 (nozzle 602-1 to nozzle 602-26) and these nozzles are divided into two 13-nozzle blocks 601A (nozzle 602-1 to nozzle 602-13) and 601B (nozzle 602-14 to nozzle 602-26), as shown in FIG. 6A. Based on the print data for an image 600, the number of ink ejections from each nozzle is counted during printing as a dot count. FIG. 6B represents a result of dot counts of nozzles 601-1 to 601-13 in the first block 601A. FIG. 6C shows a result of dot counts of nozzles 601-14 to 601-26 in the second block 601B. In the first block 601A, a nozzle whose ink ejection number is maximum, i.e., the maximum print nozzle with a largest dot count, is nozzle 602-7 that prints a line 603. In this example, the nozzle 602-7 prints 26 dots to form the line 603 and thus the dot count of the nozzle 602-7 is 26. In the second block 601B, the maximum print nozzle is 602-20 and its dot count is 9.

Figure 7:
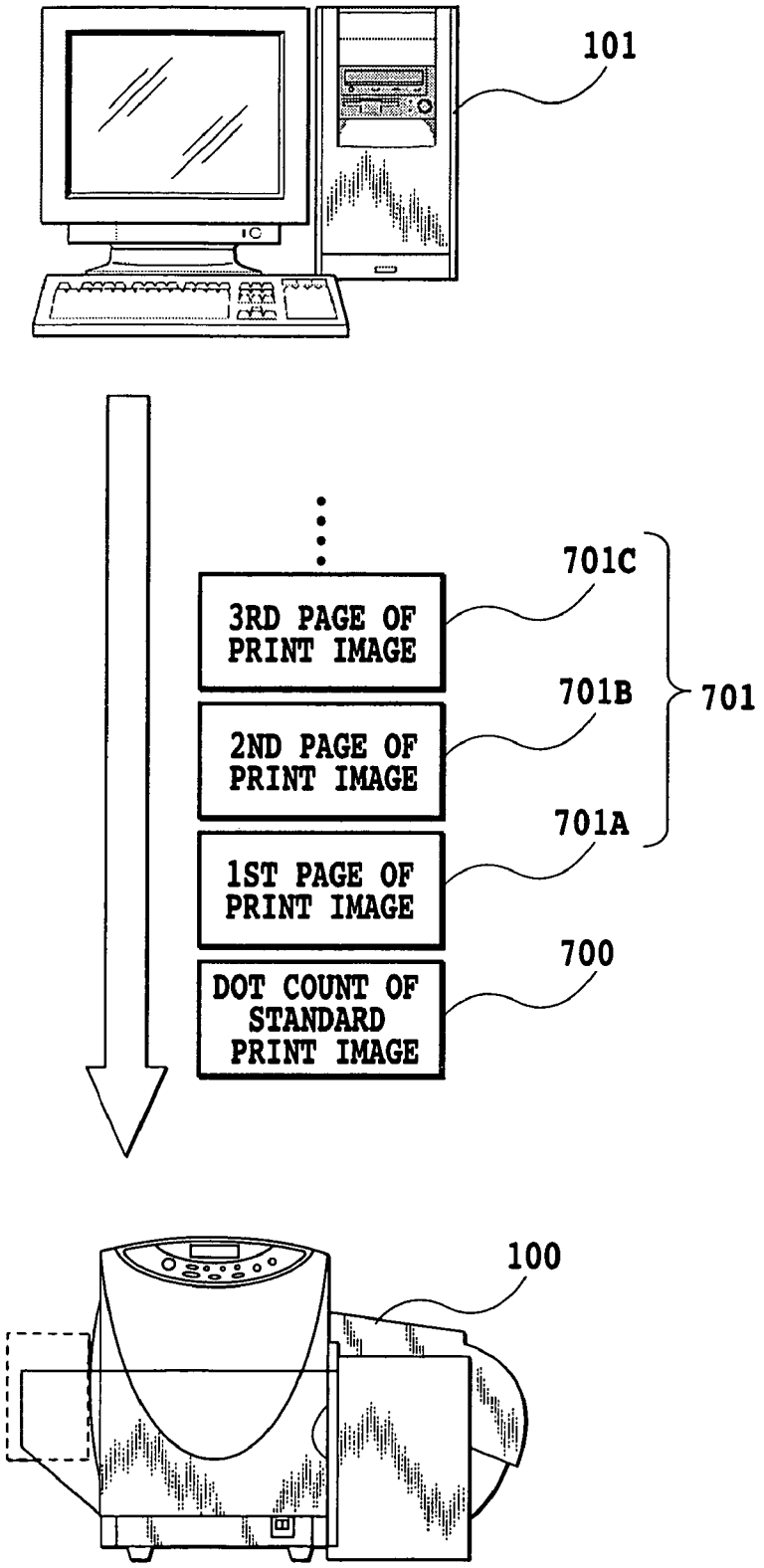
FIG. 7 is an explanatory view showing an order of data transfer between the host computer and the printing apparatus of FIG. 1.
Figure 8A:
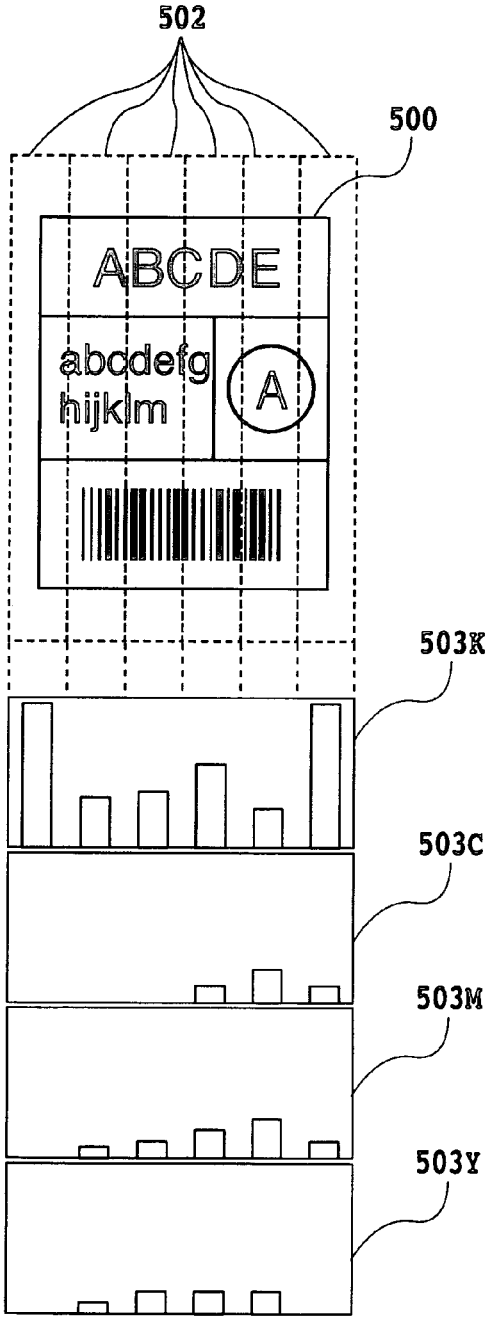
FIG. 8A is an explanatory view showing a relation between the standard image that can be printed by the printing apparatus of FIG. 1 and the dot count information on those portions of the standard image printed with cyan, black, yellow and magenta ink.
Figure 8B:
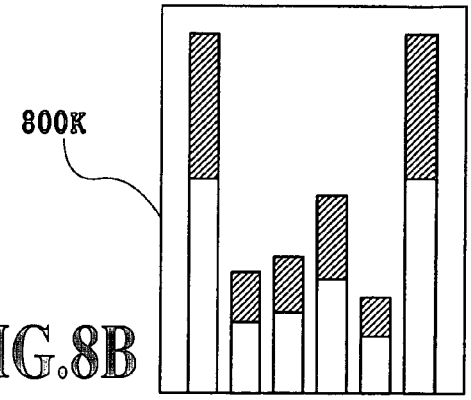
FIGS. 8B, 8C, 8D and 8E are explanatory diagrams showing service life management data of the print head for cyan, black, yellow and magenta ink in the printing apparatus of FIG. 1.
Figure 8C:
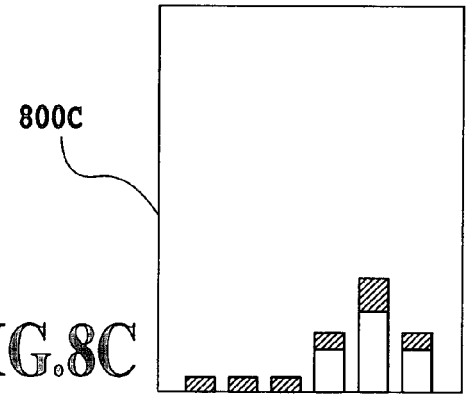
Figure 8D:
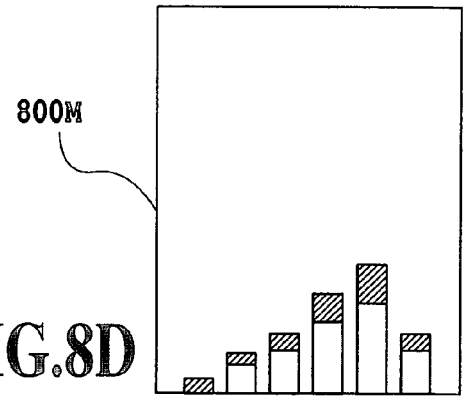
Figure 8E:
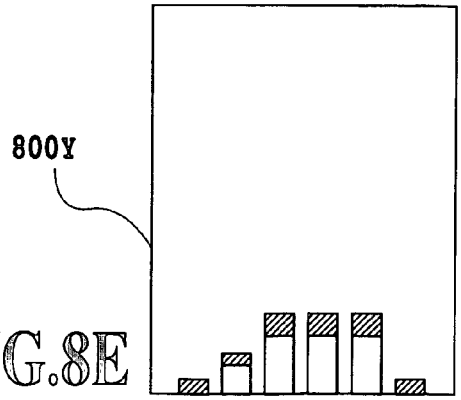

FIG. 7 is an explanatory diagram showing an order of data transfer between the host computer 101 and the printing apparatus 100 in this embodiment. The dot count information 700 of the standard print image 500 measured by the host computer 101 is notified to the printing apparatus 100 before the host computer 101 sends print data 701 (701A, 701B, 701C, . . . ) for a plurality of pages (a plurality of labels 402) to the printing apparatus 100.

FIG. 8A to FIG. 8E are explanatory diagrams showing how the printing apparatus 100 measures print head service life management data from the dot count information of the standard print image 500.

After printing a plurality pieces of print data 701, the printing apparatus 100 multiplies the dot counts 503K-503Y (FIG. 8A) of the standard print image 500 already transferred from the host computer 101 by the number of printed pages (the number of printed labels 402). Then, the printing apparatus 100 adds the multiplied result to the head service life management data 800K-800Y (see FIG. 8B to FIG. 8E) for each block. In the head service life management data 800K-800Y of FIG. 8B to FIG. 8E, shaded portions are current values obtained by multiplying the dot count data 503K-503Y by the number of printed pages and are added to accumulated values (non-shaded portions). The resulting head service life management data 800K-800Y are compared with a predetermined value. If there is any print head that includes one or more blocks exceeding the predetermined value, the print head is judged as having reached the end of its life (judged as error) and the error and the head service life management data are informed to the host computer 101. In the event of an error, the host computer 101 displays the head service life management data along with an error message in a graph to notify the user of the print head that has reached the end of its life.

Figure 9:
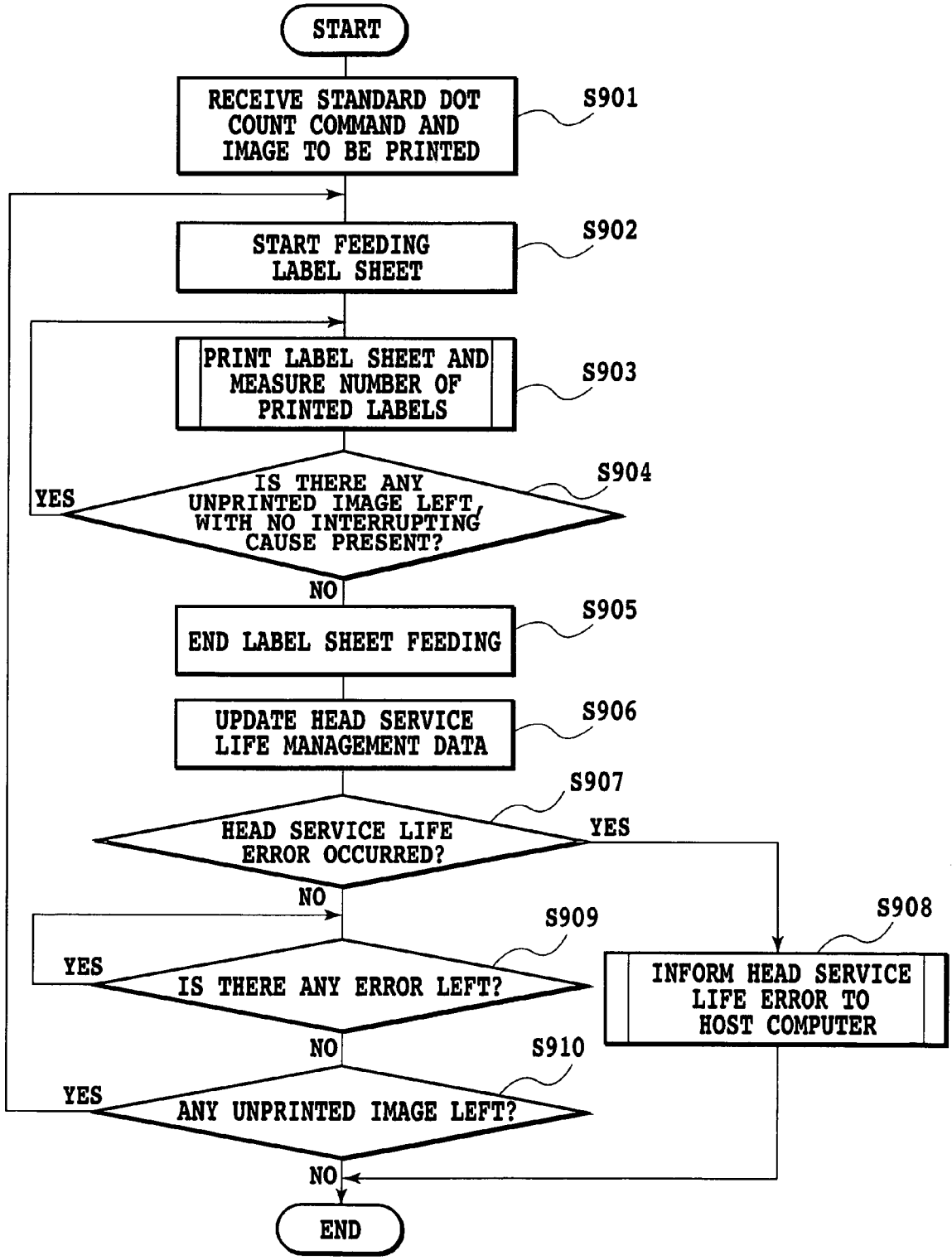
FIG. 9 is a flow chart showing a dot count processing performed in the printing apparatus of FIG. 1.

FIG. 9 is a flow chart to explain the dot count processing performed in the printing apparatus 100 of this embodiment.

First, the host computer 101 sends to the printing apparatus 100 as variable information or copy information a paper setting command specifying the number and size of labels 402 to be printed, a dot count command for the standard print image, and print data 701 to be printed. The print data 701 is stored in RAM 310K-310Y and electronic information such as dot count information is stored in RAM 310R (step S901).

The print data and the electronic information are attached with additional information indicating attributes of these information. After the print data has been received, the continuous label sheet 210 begins to be fed (step S902). In the next step S903 of printing the continuous label sheet 210, a first label piece 402 is transported to the printing position and printed. The number of labels 402 printed in this manner is counted.

The step S903 is repeated until the number of pages printed with all the print data 701 transferred reaches a set value or until a factor for interrupting the printing operation of the continuous label sheet 210, such as transport anomaly error, occurs. If the number of printed labels 402 has reached the set value and there is no remaining print information that has yet to be printed or if a printing operation interrupting situation arises (step S904), the last printed label piece 402 is discharged from the transport outlet before ending the transport operation (step S905).

In the next step S906 of updating the head service life management data, as described above, the dot count of the standard print image is multiplied by the number of printed pages and the multiplied result is added to the head service life management data 800K-800Y. The resultant head service life management data 800K-800Y after addition is compared with a specified value. If there is any print head that includes even one block exceeding the specified value, it is decided that the print head in question has reached the end of its life and a head service life error is issued (step S907). The print apparatus 100 notifies the head service life error to the host computer 101 (step S908) and ends processing without performing the printing operation.

When the printing operation is interrupted by an anomaly error, the processing waits for the error to be cleared (step S909). A check is made to see if there is any remaining print image that has yet to be printed. If so, the processing returns to step S910.

The dot counts 503K-503Y in this example are each a dot count with the largest number of ink ejections in a predetermined number of nozzles (in a predetermined block). Therefore, when line data is printed for example, the number of ink ejections (equivalent to the number of dots formed) can be measured precisely, improving the accuracy in determining whether or not the end of life of the print head is reached. In this example, as described above, the host computer 101 counts the number of dots based on the standard print data (print data of standard print image) and notifies the dot count of the standard print image to the printing apparatus 100 in advance. After performing the printing operation, the printing apparatus 100 checks the head service life based on the dot count of the printed pages (printed labels). Thus, there is no need to perform the dot counting each time one label (one page) is printed, preventing throughput degradation. Further, since the dot count of the common standard print image is transmitted each time a plurality of labels (pages), not one label (page), are printed, the transmission of the dot count does not interfere with the print data transfer.

Further, if ink is ejected from nozzles as part of a recovery operation to maintain the ink ejection performance of the print head in good condition, the dot count may be determined by including the number of printed pixels equivalent to the volume of ink ejected for recovery. The recovery operation includes not only the operation of ejecting from nozzles ink that does not contribute to image forming as described above but also an operation of drawing by suction the ink that does not contribute to the image forming and discharging it.

Second Embodiment

In the first embodiment, the present invention has been applied to the printing apparatus capable of performing a 4-color printing. This invention, however, is not limited to such a printing apparatus but may be applied to other types of printing apparatus, such as one mounting a plurality of single-color print heads. In that case, the dot count to be added to the head service life management data need only be divided by the number of print heads.

Figure 10:
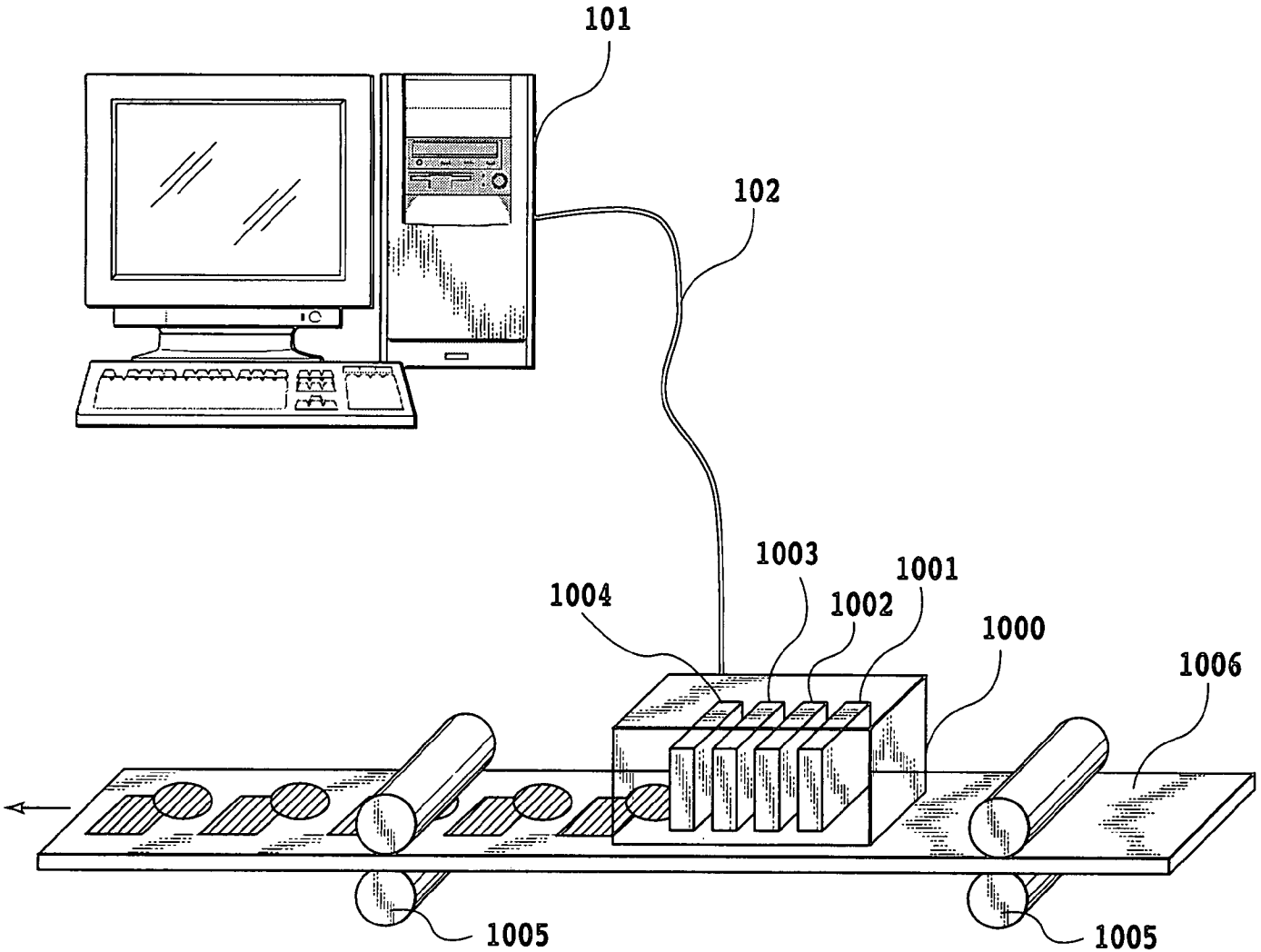
FIG. 10 illustrates an outline configuration of a printing system having a printing apparatus of a second embodiment of this invention and a host computer connected with the printing apparatus.

FIG. 10 shows an outline configuration of a printing system in which a printing apparatus 1000 using a plurality of single-color print heads is connected with a host computer 101.

The printing apparatus 1000 of this embodiment is a monochromatic ink jet printing apparatus using four elongate print heads (line heads), each print head extending over an entire width of a print area of a print medium 1006. The printing apparatus 1000 is connected with the host computer 101 through a printer cable 102 and prints an image according to a variety of data processed by the host computer 101. The host computer 101 can detect a status of the printing apparatus 1000 based on error information of the printing apparatus 1000. The printing apparatus 1000 uses as a printing means four ink jet print heads (line heads) 1001-1004 for ejecting a black (K) ink. These print heads are supplied the black (K) ink from a common ink tank (not shown). Driving a transport unit 1005 causes a continuous print medium 1006 to be fed to a position under the print heads. When the continuous print medium 1006 is detected by a sensor (not shown), the print heads 1001-1004 are driven, with a detection signal as a trigger, to form an image on the continuous print medium 1006.

The four print heads 1001-1004 cooperate to form a black image. The print data to be printed, therefore, is distributed among the four print heads 1001-1004. The use of the four print heads 1001-1004 reduces a burden on each print head to about one fourth that when an image is printed using one print head.

Figure 11A:
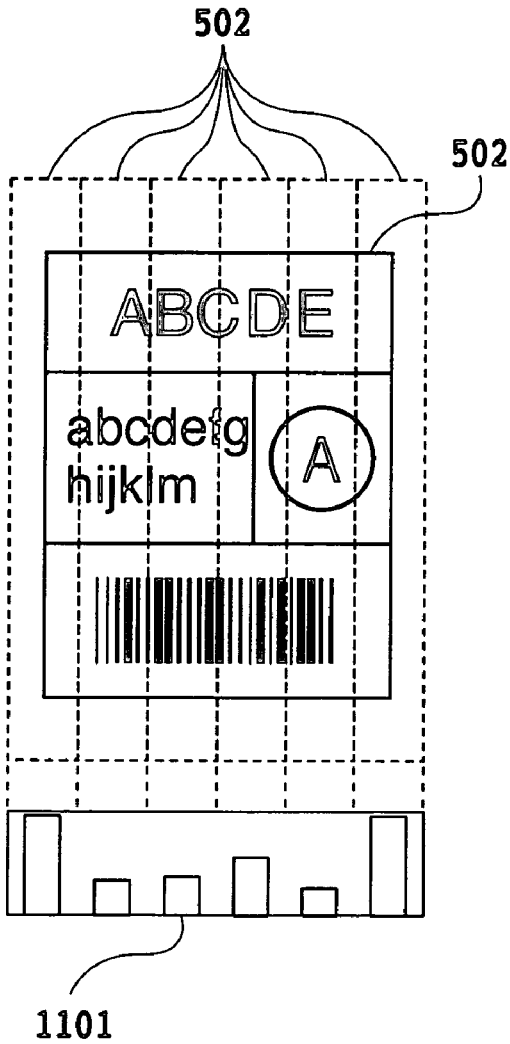
FIG. 11A is an explanatory view showing a relation between the standard image that can be printed by the printing apparatus of FIG. 10 and the dot count information.
Figure 11B:
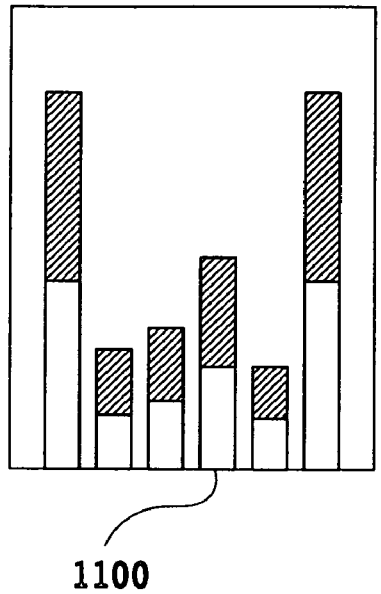
FIG. 11B is an explanatory diagram showing service life management data of the print head in the printing apparatus of FIG. 10.

FIG. 11A and FIG. 11B are explanatory views showing how the printing apparatus 1000 of this example measures print head service life management data from the dot count information of a standard print image.

After printing an image according to a plurality of pieces of print data, the printing apparatus 1000 multiplies the dot count 1101 for each block of the standard print image of FIG. 11A by the number of pages and divides the multiplied result by four, the number of the print heads, to obtain a value (of a shaded portion of FIG. 11B). The value of the shaded portion of FIG. 11B for each block is then added to the head service life management data. If, as a result of this addition operation, there is any print head that has one or more blocks exceeding a predetermined value, it is decided that the print head in question has reached the end of its life. The printing apparatus 1000 then informs a service life error to the host computer 101, which in turn displays the head service life management data in a graph along with an error message to notify the user which print head has reached the end of life.

In this example, as described above, when printing single-color print data with a plurality of print heads, the life of the print heads can easily be managed, preventing throughput degradation.

Other Embodiments

In the first and second embodiment, a head life error notification is made after the printing operation. It is also possible, before starting the printing operation, to make an estimation of what the head service life management data will be after the printing operation, based on the standard print image and the number of pages to be printed and to notify of a possible error and head service life management data in advance.

In a configuration in which a plurality of short print heads are arranged in line in a widthwise direction of the print medium to construct an elongate print head extending over the entire width of a print area of the print medium, it is possible to manage the life of the individual short print heads. In that case, an instruction may be issued requiring those of the short print heads which are near the end of life to be replaced with other short print heads that are located at positions where the ink ejection frequency is low. This makes the frequency of use uniform among the short print heads.

This invention can also be applied to a system constructed of a plurality of devices (e.g., host computer, interface device and printer) or to an apparatus composed of one device (e.g., copying machine and facsimile).

Further, the object of this invention can of course be achieved by supplying a system or apparatus with a storage medium containing program codes of software that realizes the functions of the above embodiments, and by having a computer (or CPU or MPU) of the system or apparatus read and execute the program codes stored in the storage medium. In that case, the program codes read out from the storage medium realize the functions of the embodiments and the storage medium containing the program codes constitutes the present invention.

Storage media that may be used to supply program codes include, for example, floppy (registered trademark) disks, hard disks, optical discs, magnetooptical discs, CD-ROMs, CD-Rs, magnetic tapes, nonvolatile memory cards and ROMs.

The functions of the above embodiments can be realized by the computer executing the program codes read out. It is also possible to realize the functions of these embodiments by having an OS (operating system) running on the computer execute a part or all of the actual processing according to instructions of the program codes. This case is also included in the present invention.

Further, the program codes read from the storage medium may be written into a memory on a function expansion board installed in the computer or on a function extension unit connected to the computer and, based on instructions of the program codes, the CPU in the function expansion board or function extension unit may execute a part or all of the actual processing. This case is also included in the present invention.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes.

What is claimed is:

1. A printing apparatus for printing an image on a print medium by using a print head which ejects ink from a plurality of nozzles, the plurality of nozzles being divided into a plurality of blocks, and usage history of the print head being managed for each of the blocks, the printing apparatus comprising:

counting means for counting the number of pixels printed by the plurality of nozzles for each of the blocks;

management means for accumulating, for each of the blocks on the basis of the number counted by the counting means, the number of pixels printed by a nozzle in each of the blocks which prints a maximum number of pixels in a predetermined printing operation and managing the accumulated number for each of the blocks, the number of pixels printed by another nozzle in each of the blocks which does not print the maximum number of pixels not being accumulated; and outputting means for outputting an error information on the basis of data concerning the accumulated number for each of the blocks which are managed by the managing means, wherein the outputting means outputs the error information when at least one of the data concerning the accumulated numbers for each of the blocks exceeds a reference value.

2. The printing apparatus according to claim 1, wherein the counting means counts the number of printed pixels based on print data that is used to print an image on the print medium.

3. The printing apparatus according to claim 1, wherein the management means multiplies, for each of the blocks, the number of pixels printed by a nozzle in each of the blocks which prints a maximum number of pixels in a predetermined printing operation by the number of the pages to be printed and manages the multiplied result as the accumulated number.

4. The printing apparatus according to claim 1, wherein the counting means counts the number of printed pixels by including those pixels equivalent to an ink volume that is ejected from the nozzles to maintain an ink ejection performance of the print head in good condition.

5. The printing apparatus according to claim 1, wherein the outputting means outputs information on the number of printed pixels in a form of data that can be presented in a graph for each of the blocks.

6. The printing apparatus according to claim 1, further including control means for stopping a printing operation when the error information is outputted from the outputting means.

7. The printing apparatus according to claim 1, wherein the print head is comprised of a plurality of print heads to which print data to print an image on the print medium is distributed, and the management means manages a value obtained by dividing the accumulated number by the number of print heads.

8. The printing apparatus according to claim 1, wherein the print head is an elongated print head extending over an entire width of a printing area of the print medium, wherein transport means is provided which transports the print medium in a direction crossing the width direction of the printing area.

9. An image processing apparatus for sending print data to a printing apparatus, the image processing apparatus comprising:

transmission means for sending information on the number of standard image pixels to the printing apparatus;

wherein the printing apparatus prints an image on a print medium by using a print head which ejects ink from a plurality of nozzles, the plurality of nozzles being divided into a plurality of blocks, and usage history of the print head being managed for each of the blocks, and wherein the printing apparatus comprises management means for multiplying, for each of the blocks, the number of standard image pixels printed by a nozzle in each of the blocks which prints a maximum number of pixels in a predetermined printing operation by the number of the pages to be printed and managing the multiplied result, the number of pixels printed by another nozzle in each of the blocks which does not print the maximum number of pixels not being multiplied.

10. The image processing apparatus according to claim 9, wherein the transmission means sends information on the number of the standard image pixels to the printing apparatus before the printing apparatus starts a printing operation.

11. The image processing apparatus according to claim 9, wherein the transmission means sends to the printing apparatus information on a value that is obtained by multiplying the number of standard image pixels by the number of the pages before the printing apparatus starts a printing operation.

* * * * *